US006932664B2

(12) United States Patent
Yamada et al.

(10) Patent No.: US 6,932,664 B2
(45) Date of Patent: Aug. 23, 2005

(54) GAS DISCHARGE TUBE AND METHOD FOR FORMING ELECTRON EMISSION LAYER IN GAS DISCHARGE TUBE

(75) Inventors: Hitoshi Yamada, Kawasaki (JP); Akira Tokai, Kawasaki (JP); Manabu Ishimoto, Kawasaki (JP); Tsutae Shinoda, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 64 days.

(21) Appl. No.: 10/076,333

(22) Filed: Feb. 19, 2002

(65) Prior Publication Data

US 2003/0025451 A1 Feb. 6, 2003

(30) Foreign Application Priority Data

Jul. 31, 2001 (JP) ..... 2001-232449

(51) Int. Cl.[7] ..... H01J 9/24; H01J 61/00

(52) U.S. Cl. ..... 445/24; 445/25; 445/26; 313/607; 427/226

(58) Field of Search ..... 313/607, 634, 313/483–485, 306, 581, 201, 621, 243, 488; 445/24–26, 14; 427/226, 67

(56) References Cited

U.S. PATENT DOCUMENTS

| | | | | | |
|---|---|---|---|---|---|
| 3,809,944 | A | * | 5/1974 | Jongerius et al. | 313/485 |
| 4,983,881 | A | * | 1/1991 | Eliasson et al. | 313/607 |
| 5,013,966 | A | * | 5/1991 | Saikatsu et al. | 313/493 |
| 5,049,777 | A | * | 9/1991 | Mechtersheimer | 313/35 |
| 6,376,691 | B1 | * | 4/2002 | Celinska et al. | 556/28 |
| 6,686,489 | B2 | * | 2/2004 | Celinska et al. | 556/28 |

FOREIGN PATENT DOCUMENTS

| | | |
|---|---|---|
| JP | SHO 61-103187 | 5/1986 |
| JP | HEI 11-162358 | 6/1999 |

* cited by examiner

*Primary Examiner*—Joseph Williams
*Assistant Examiner*—Dalei Dong
(74) *Attorney, Agent, or Firm*—Staas & Halsey

(57) ABSTRACT

A gas discharge tube includes a plurality of light-emitting portions that are provided outside of the tube, at least two discharge electrodes, and an electron emission film formed on the entire inner wall of the tube for improving discharge characteristics.

13 Claims, 13 Drawing Sheets

30
38
UPON BURNING
39

40

BURNING

GAS DISCHARGE TUBE AND METHOD FOR FORMING ELECTRON EMISSION LAYER IN GAS DISCHARGE TUBE

CROSS-REFERENCES TO RELATED APPLICATIONS

This application is related to Japanese applications No. 2001-232449 filed on Jul. 31, 2001, whose priority is claimed under 35 USC §119, the disclosures of which are incorporated by reference in their entirety.

BACKGROUND OF THE INVENTION

1. Field of the Invention

The present invention relates to a gas discharge tube and a method for forming an electron emission film into the gas discharge tube, and more particularly to a thin gas discharge tube having a diameter of approximately 0.5 to 5 mm and a method for forming an electron emission film into the gas discharge tube suitably adapted for such a gas discharge tube.

2. Description of the Related Arts

A conventional gas discharge tube is provided with electrodes at end edges with respect to the longitudinal direction of the discharge tube for extending a discharge in the longitudinal direction. Films of an electron emission material (electron emission film) that improves discharge characteristics are directly formed on filaments serving as the electrodes. Therefore, the filaments to which the electron emission film is vapor-deposited are adhered to be fixed onto the end edges of the discharge tube in manufacturing the gas discharge tube.

There are other gas discharge tubes than the above-mentioned discharge tube, one of which is provided with a lot of electrodes on the side of the tube. A display device in which a plurality of such slender, long gas discharge tubes are arranged has been known.

A screen of this display device is composed of a great number of light emitting elements (tubular-light-emitting elements: gas discharge tubes) arranged in a line direction (a column direction) of the screen. The light emitting elements are formed of hollow, slender, long glass tubes having a diameter of approximately 0.5 to 5 mm whose outer walls are provided with electrodes and in which a discharge gas is enveloped. Known display devices of the above-mentioned type are a large gas discharge display panel disclosed in Japanese Unexamined Patent Publication No. Sho 61(1986)-103187 and an image display device disclosed in Japanese Unexamined Patent Publication No. Hei 11(1999)-162358. The display device of this type has advantages of reduced assembling man-hour, light-weight and low cost, easy to change the screen size or the like.

A gas discharge tube used for this display device has a structure of having a plurality of electrodes that can generate facing discharge or surface discharge inside the discharge tube. A discharge is generated in a direction between the side faces of the discharge tube so as to obtain a great number of light-emitting points in one tube.

Considering withstand voltage of a driving circuit and a cost of circuit components, voltage for generating a discharge between electrodes (voltage for initiating a discharge) in the gas discharge tube is desired to be low. Accordingly, an electron emission film is formed onto a discharge face for improving discharge characteristics.

This gas discharge tube is provided with electrodes at the outer wall of the tube as described above, so that the formation of the electrodes is easy, but the electron emission film is not attributed to the improvement of the discharge characteristics since the electron emission film is not in direct contact with the discharge gas even though the electron emission film is directly formed onto the electrodes.

In order to solve this problem, the electron emission film may be formed onto the inner wall of the tube, not on the electrodes positioned outside of the discharge tube. This can improve the discharge characteristics.

However, it is extremely difficult to form the electron emission film on the inner wall of the slender, long glass tube having a diameter of 2 mm or less and a length of 200 mm or more.

For example, a film-formation by a vapor deposition method brings a non-uniform distribution of the film thickness in the tube since evaporating molecules of a material for forming an electron emission film introduced from the tube edge is significantly accumulated in the vicinity of the tube edge. The uneven thickness of the electron emission film causes variations in the voltage for initiating the discharge at a great many of light-emitting points in the tube, thereby arising a problem of narrowing the margin of the light-emitting operation.

SUMMARY OF THE INVENTION

The present invention is accomplished in view of these circumstances, and aims to improve discharge characteristics and reduce the unevenness of the light-emitting operation among many light-emitting points by forming an electron emission film on the inner wall of a gas discharge tube with a uniform thickness.

The present invention provides a gas discharge tube comprising a plurality of light-emitting portions that are provided outside of the tube and comprise at least two discharge electrodes, and an electron emission film formed on the entire inner wall of the tube for improving discharge characteristics.

The gas discharge tube according to the present invention has the electron emission film formed on the entire inner wall of the tube, whereby discharge characteristics is improved upon generating a discharge between discharge electrodes via the gas discharge tube.

The present invention also provides a method for forming an electron emission film into a gas discharge tube comprising a step of injecting coating solution from one opening of a tube at a predetermined amount, said coating solution including an organic metal compound that becomes an inorganic metal compound having an electron emission ability by a burning process; a step of forming a coating film on the entire inner wall of the tube by causing the coating solution to trickle down the inner wall of the tube while entirely sealing the opening of the tube; and a step of burning the coating film for forming an electron emission film on the entire inner wall of the tube.

The method for forming an electron emission film according to the present invention comprises a step of injecting coating solution from one opening of a tube at a predetermined amount; a step of forming a coating film on the entire inner wall of the tube by causing the coating solution to trickle down the inner wall of the tube while entirely sealing the opening of the tube and a step of burning the resultant film, whereby an electron emission film having a uniform thickness can be formed on the entire inner wall of the tube. The formation of the electron emission film having a uniform thickness can reduce the voltage for initiating the discharge of the gas discharge tube as well as can widely assure a margin of a light-emitting operation at many light-emitting points.

BRIEF DESCRIPTION OF THE DRAWINGS

The present invention will become more fully understood from the detailed description given hereinbelow and the accompanying drawings which are given by way of illustration only, and thus are not to be considered as limiting the present invention.

DESCRIPTION OF THE PREFERRED EMBODIMENT

Figure 1:
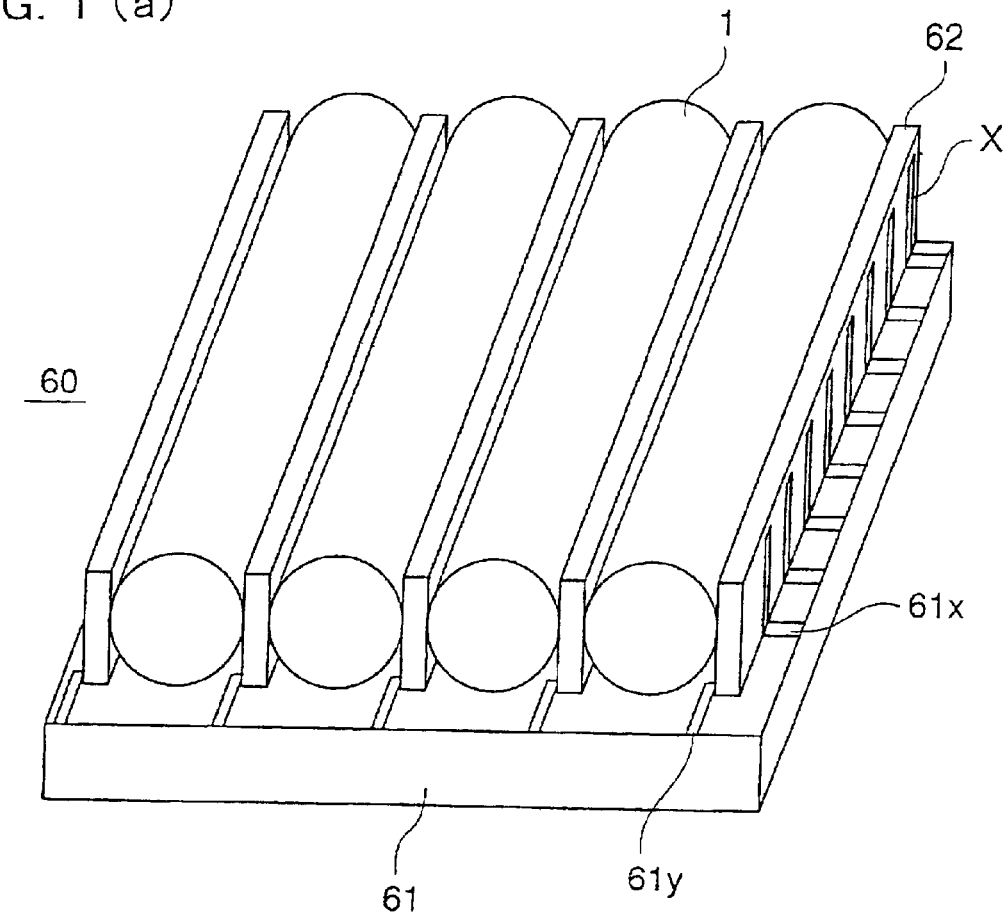
FIGS. 1(*a*) and 1(*b*) are explanatory views showing a display device using a gas discharge tube according to the present invention.
Figure 1:
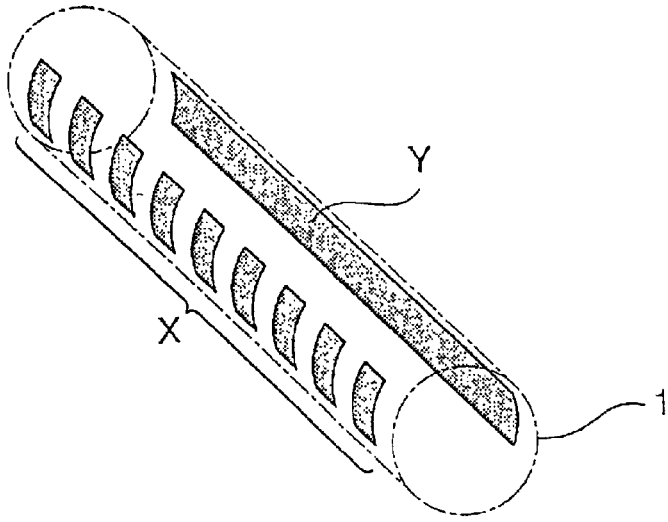

The method for forming an electron emission film according to the present invention can suitably be adapted to a gas discharge tube made of a slender tube having a diameter of about 0.5 to 5 mm.

In the present invention, the coating solution may contain an organic metal compound that becomes an inorganic compound having an electron emission ability by burning. A mixture solution of an organic metal compound that becomes an inorganic compound having the electron emission ability by burning and an inorganic compound can be used as the coating solution. Specifically, the organic metal compound is coated onto the entire inner wall of the tube with a solvent, and then, this coated film is burned to obtain the inorganic metal compound having the electron emission ability, to thereby form the electron emission film on the entire inner wall of the tube.

The coated film obtained by applying the coating solution is desirably burned at a temperature of about 350 to 480° C. The burning process changes the organic metal compound contained in the coating solution into the inorganic metal compound having an electron emission ability. Examples of the inorganic metal compound having the electron emission ability are metal oxides such as magnesium oxide, alumina and the like.

In order to form the electron emission film made of a metal oxide such as magnesium oxide, alumina and the like, the organic metal compound contained in the coating solution may be an organic metal compound including a metal such as magnesium, aluminum and the like. Examples of the organic metal compound are magnesium stearate, magnesium valerate and the like. When a magnesium oxide film is formed as the electron emission film, magnesium hexanoate (also referred to magnesium caproate) is desirably used as the organic metal compound containing magnesium.

Examples of a solvent for the above-mentioned organic metal compound include ethanol, 1-propanol, 1,3-propanediol, 1-butanol and the like. In case where magnesium hexanoate is used as the organic metal compound, a mixture solution of ethanol and propylene glycol monomethyl ether acetate is desirably used since magnesium hexanoate is freely soluble in this mixture solvent and the use of the mixture solvent improves the coating property of the coating solution.

The present invention will be explained hereinbelow with reference to the embodiments shown in the drawings. It is to be noted that the present invention is not limited to the embodiments described below and can be modified in various ways.

A gas discharge tube and a method for forming an electron emission film in the gas discharge tube is preferably adapted to a gas discharge tube for display. An entire construction of this gas discharge tube for display is firstly explained.

FIG. 1(*a*) is a perspective view showing in partial a display device using gas discharge tubes according to the present invention, while FIG. 1(*b*) is an explanatory view showing a gas discharge tube having an electrode formed therein.

A display device 60 of this embodiment has a plurality of gas discharge tubes 1 that are arranged in a line direction of a screen and formed on a substrate 61 at the back side of the display device. An electrode supporting member 62 is arranged between each gas discharge tube 1. The electrode supporting member 62 has an electrode X formed at one side and an electrode Y formed at the other side for selectively generating emission with an optional combination of a plurality of portions (cells) in the lengthwise direction of the gas discharge tube 1. Wiring conductive patterns 61*x* and 61*y* are provided on the substrate 61 for applying voltage to these electrodes X and Y.

Provided also on the outer wall surface of the gas discharge tube 1 are electrodes X and Y at each position corresponding to the electrodes X and Y on the electrode supporting member 62, thereby forming an electrode matrix capable of displaying an optional image. Inert gas (discharge gas) including Ne (neon), Xe (xenon) and the like is enclosed in the gas discharge tube 1.

Figure 2:
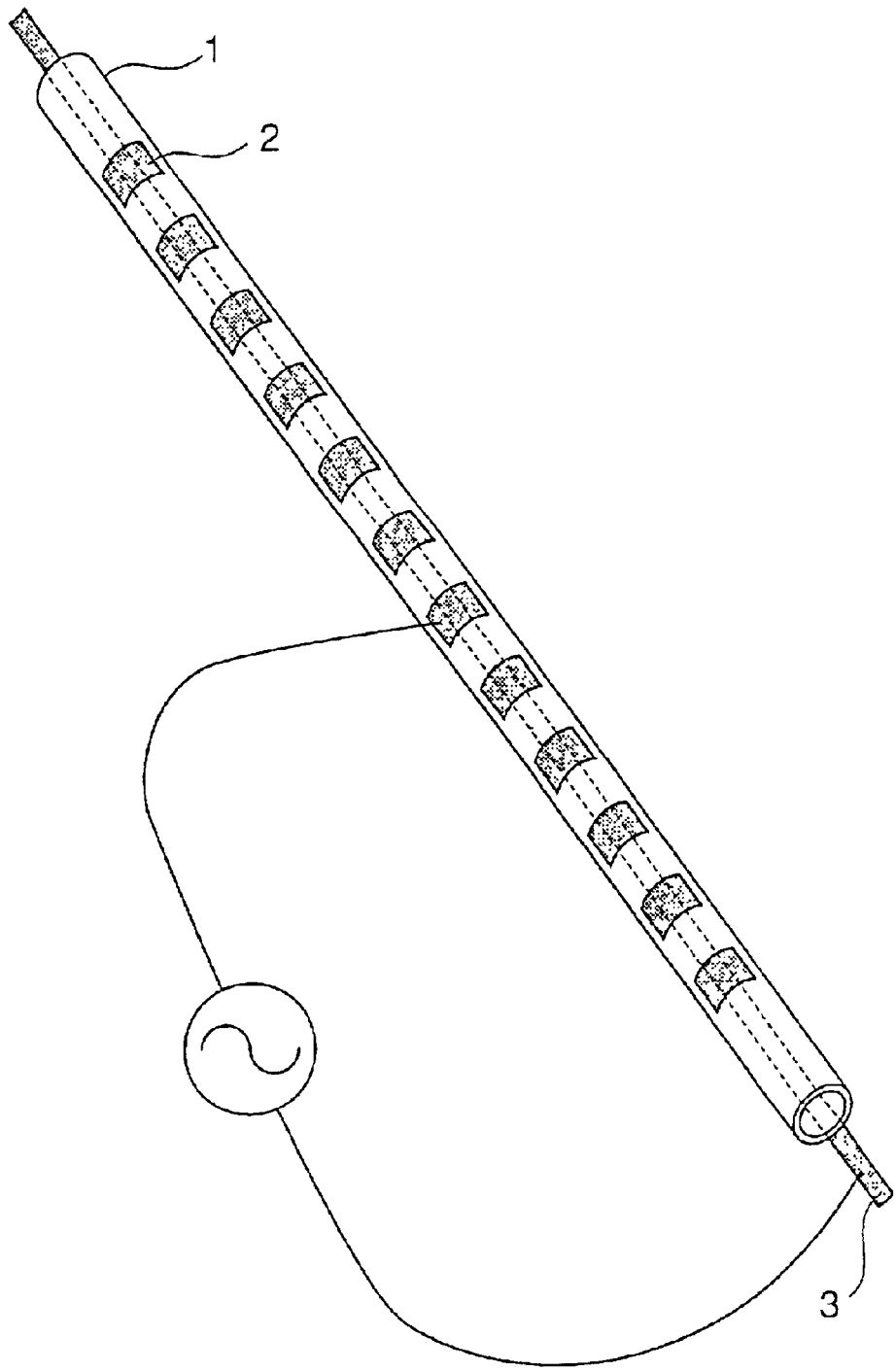
FIG. 2 is an explanatory view showing an entire construction of one embodiment of the gas discharge tube according to the present invention.

FIG. 2 is an explanatory view showing an entire construction of a gas discharge tube according to one embodiment of the present invention. The gas discharge tube (hereinafter simply referred to as discharge tube) of this embodiment has on its outer wall a great number of electrode pairs comprising at least two electrodes. These electrodes generate a discharge in a sideward direction of the tube for obtaining a great number of emitting points in one tube.

In the same figure, numeral 1 designates a gas discharge tube, numeral 2 a front electrode and numeral 3 a back electrode. The gas discharge tube 1 is made of an insulating material such as glass or the like. The front electrode 2 corresponds to the electrode X in FIG. 1(*b*) and the back electrode corresponds to the electrode Y in the same figure. The front electrode 2 and the back electrode 3 are mounted to the outer wall of the gas discharge tube 1. An application of alternate voltage between the front electrode 2 and the back electrode 3 generates a discharge between the front electrode 2 and the back electrode 3 in the gas discharge tube 1.

The front electrode 2 and the back electrode 3 are, when each having a structure capable of applying voltage to the discharge gas in the tube, not necessarily formed in direct contact with the outer wall of the gas discharge tube 1. Such a structure may be possible that a member to which an electrode is formed gets in contact with the gas discharge tube 1.

Although this embodiment shows the electrode structure in which one emitting point is formed by a first electrode (front electrode 2) and a second electrode (back electrode 3) which are opposed to each other, the invention is not limited thereto. A structure having a third electrode may be possible. Further, an electrode structure for generating a surface discharge may be adapted, although the figure of this embodiment shows the electrode structure for generating an opposition discharge.

Figure 3:
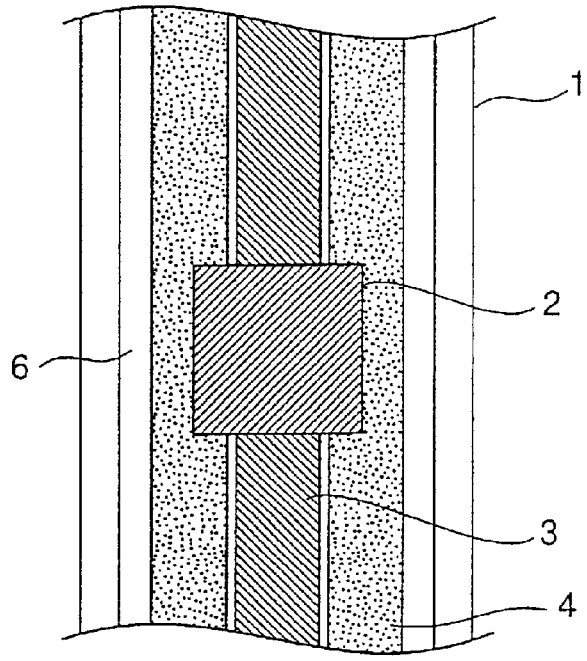
FIGS. 3(*a*) and 3(*b*) are explanatory views showing an inner construction of the gas discharge tube in the embodiment.
Figure 3:
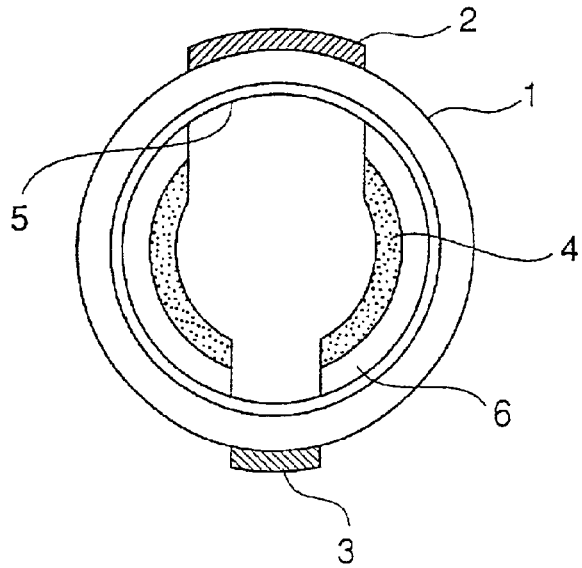

FIGS. 3(*a*) and 3(*b*) are explanatory views showing the inner structure of the gas discharge tube, wherein FIG. 3(*a*) shows a longitudinal sectional view and FIG. 3(*b*) shows a cross-sectional view. In these figures, numeral 4 designates a fluorescent layer, numeral 5 an electron emission film and numeral 6 a supporting plate.

With respect to the gas discharge tube 1 of the present invention, an application of high voltage between the front electrode 2 and the back electrode 3 excites the discharge gas enveloped in the tube, with the result that vacuum ultraviolet light is generated in the de-excitation process of the excited inert gas. The fluorescent layer 4 receives the vacuum ultraviolet ray and generates visible light.

The electron emission film 5 generates charged particles by a collision with discharge gas having energy of more than a predetermined amount.

The supporting plate 6 serves for introducing the fluorescent layer 4 into the discharge tube. This supporting plate 6 may not be provided.

The gas discharge tube 1 of this embodiment has the electron emission film 5 formed at a discharge generating portion, whereby a production of minimum amount of charged particles required for generating the discharge can be realized with low voltage.

Figure 4:
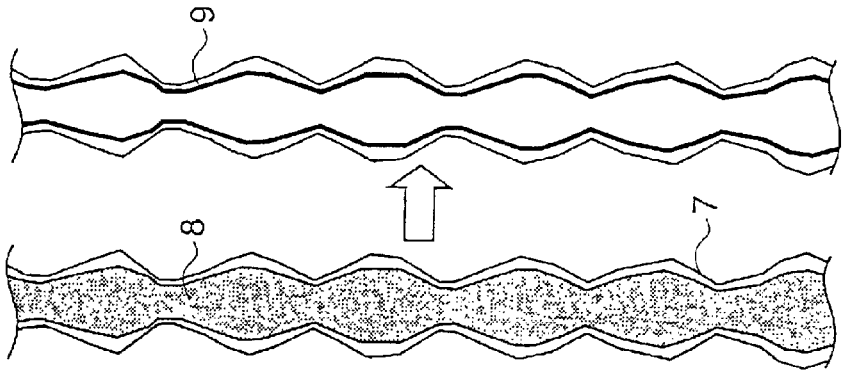
FIGS. 4(*a*) to 4(*c*) are explanatory views showing that a coating solution for forming an electron emission film is introduced into the gas discharge tube.
Figure 4:
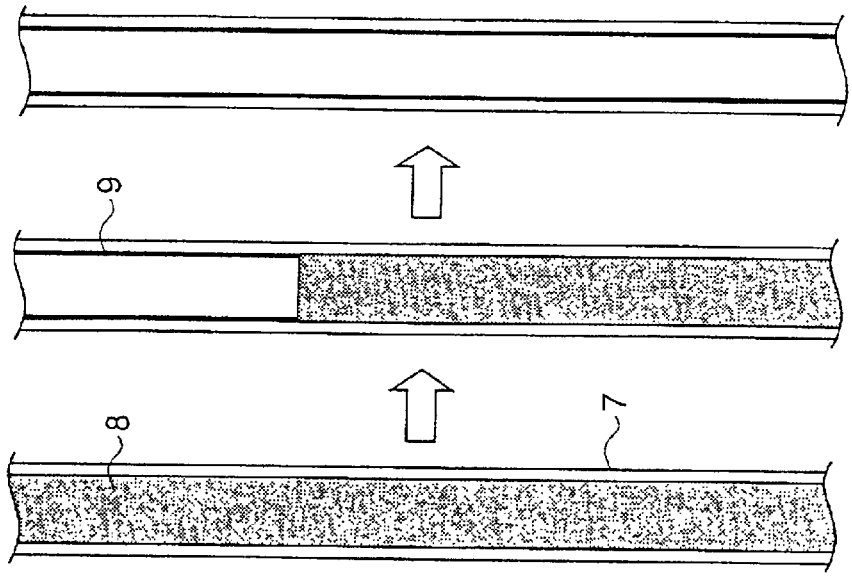
Figure 4:
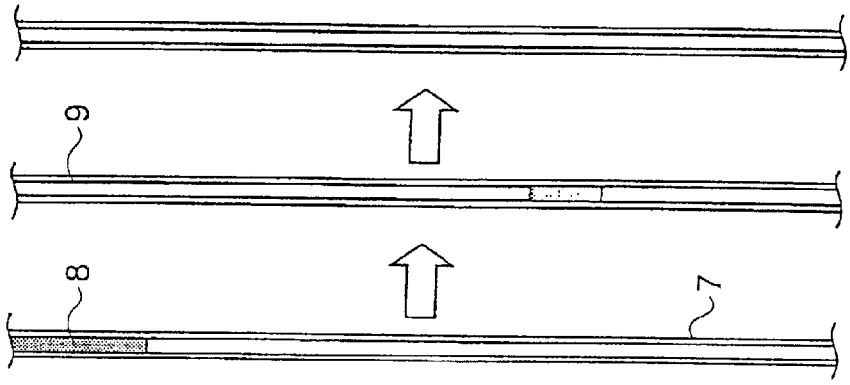

FIGS. 4(*a*) to 4(*c*) are explanatory views showing a state for introducing coating solution for forming an electron emission film into the gas discharge tube, before the electrodes are formed on the gas discharge tube, wherein FIG. 4(*a*) shows a thin tube having an inner diameter of 0.5 mm to 2 mm, FIG. 4(*b*) shows a thick tube having an inner diameter of 2 mm or more and FIG. 4(*c*) shows a modified tube.

In the figures, numeral 7 designates a discharge tube, numeral 8 coating solution for forming an electron emission film and numeral 9 a coating film formed with the coating solution.

The coating solution 8 for forming the electron emission film contains the organic metal compound which turns into the electron emission film through thermal treatment. The use of such coating solution enables the coating film to be formed regardless of the thickness, length and shape of the gas discharge tube 7. Further, the coating film having an optional film thickness can be obtained with the selection of density and solvent of the organic metal compound. Moreover, the coating solution 8 trickles down the gas discharge tube with the section of the gas discharge tube 7 sealed to form the coating film, resulting in establishing a uniform balance of physical force regarding the coating process, such as gravity, liquid viscosity, liquid surface tension, friction between the coating solution and the wall face of the tube or the like, in the circumferential direction of the tube in the vicinity of the phase boundary. Consequently, the thickness of the coating film of the tube, particularly of the straight tube can be made uniform.

Figure 5:
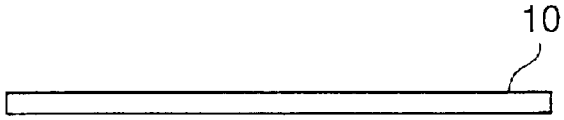
FIGS. 5(*a*) to 5(*d*) are explanatory views showing a method for introducing a coating solution into the gas discharge tube.
Figure 5:
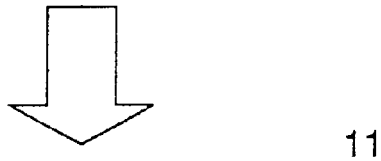
Figure 5:
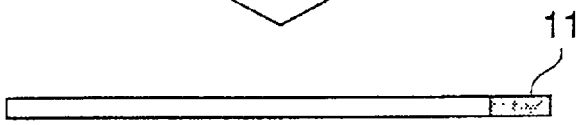
Figure 5:
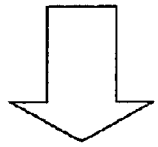
Figure 5:
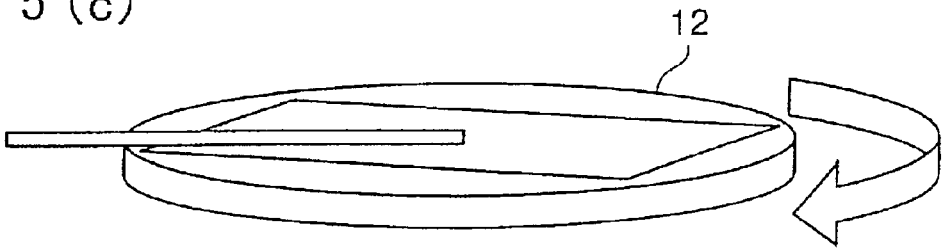
Figure 5:
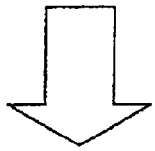
Figure 5:
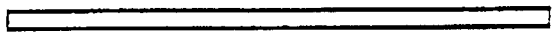

FIGS. 5(*a*) to 5(*d*) are explanatory views showing an introducing method of a coating solution.

As shown in this figure, the method for introducing a coating solution 11 into the gas discharge tube 10 includes the steps of preparing the gas discharge tube 10 (see FIG. 5(*a*)), injecting the coating solution 11 to the edge portion of the gas discharge tube 10 (see FIG. 5(*b*)) and fixing the gas discharge tube 10 onto a rotating stage of a rotating device 12. The rotating device 12 imparts centrifugal force to the coating solution 11 for sending the same into the gas discharge tube 10. A spinner is used for the rotating device 12 in this embodiment.

The rotating stage of the rotating device 12 rotates for imparting centrifugal force to the coating solution 11 (see FIG. 5(*c*)), whereby the coating solution 11 is introduced into the gas discharge tube 10 to form a uniform coating film to the inner wall face of the gas discharge tube 10 (see FIG. 5(*d*)).

Imparting strong centrifugal force to the coating solution 11 even after the coating solution 11 is uniformly applied into the gas discharge tube 10 causes a separation and evaporation of the solvent as well as a solation of the organic metal compound in the coating solution 11. Therefore, the coating film formed uniformly on the inner wall of the tube has a high viscosity, which enables to maintain the shape of the coating film even without the drying process.

Figure 6:
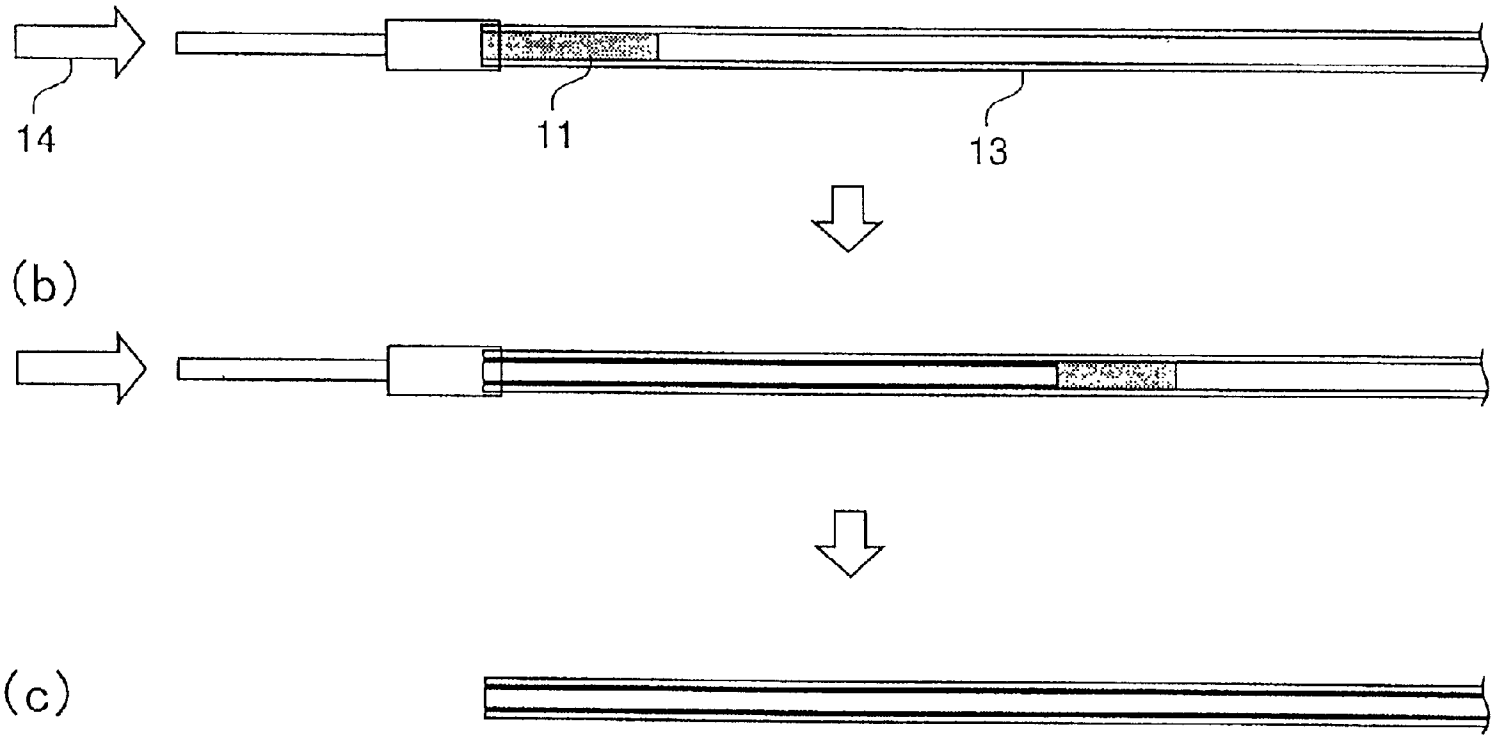
FIGS. 6(*a*) to 6(*c*) are explanatory views showing another method for introducing a coating solution into the gas discharge tube.

FIGS. 6(*a*) to 6(*c*) are explanatory views showing another method for introducing the coating solution into the gas discharge tube.

In this method, the coating solution 11 is injected into a gas discharge tube 13, and then, compressed air 14 including dry air, dry nitrogen or the like is applied thereto for introducing the coating solution 11 into the gas discharge tube 13. The use of the compressed air 14 can realize a simplified, small-sized coating apparatus as well as a reduction of coating-process time. A blast is continued even after the coating process is finished, thereby enabling to promote the drying of the coating film, enhance the viscosity of the coating film and maintain the shape of the coating film.

Figure 7:
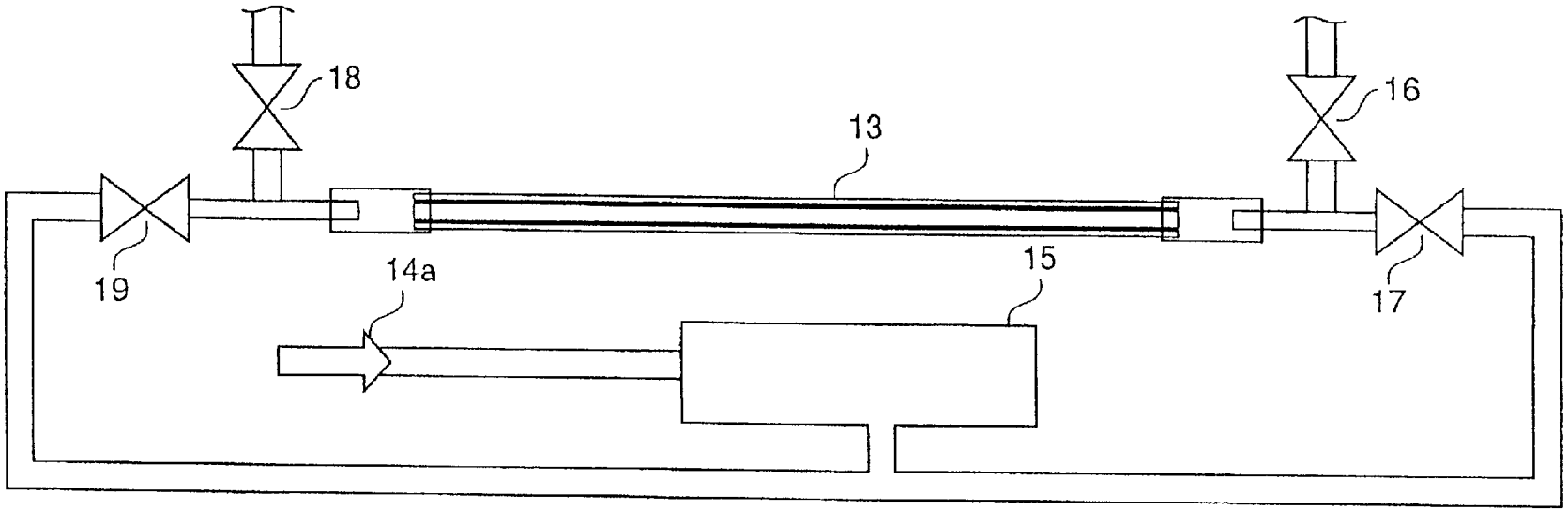
FIG. 7 is an explanatory view showing a device for introducing a coating solution into the gas discharge tube.

FIG. 7 is an explanatory view showing an introducing apparatus of the coating solution into a gas discharge tube.

In this figure, numeral 14*a* designates dry gas, numeral 15 a heater, numerals 16, 17, 18 and 19 valves.

Upon drying the coating film, air is hard to be circulated when a long thin gas discharge tube is used, since such a tube has a large piping resistance. Therefore, great pressure is required for sending the dry air, with the result that the coating film receives force toward the direction of the blast. Consequently, there arises a problem that the coating film is carried away.

In order to prevent such a problem, a blast is sent alternately from both ends of the gas discharge tube by using the apparatus shown in FIG. 7. The alternate blasting causes well-balanced force applied to the coating film for preventing the coating film from being carried away in one direction. Further, blasting air is warmed for promoting the drying of the coating film in order to prevent the coating film being carried away.

In this apparatus, the dry air 14*a* is heated by the heater 15, and then, the heated dry air 14*a* is introduced via the valve 19 into the gas discharge tube 13 to which the coating film is formed. The valves 17 and 18 are closed at this time, so that the gas passing through the gas discharge tube 13 to thereby include solvent evaporation in the coating film goes into the atmosphere via the valve 16.

Thereafter, the dry air 14*a* heated by the heater 15 is introduced via the valve 17 into the gas discharge tube 13 on which the coating film is formed. The valves 16 and 19 are closed at this time, so that the gas passing through the gas discharge tube 13 to thereby include solvent evaporation in the coating film goes into the atmosphere via the valve 18.

In this way, the dry air or the heated dry air is alternately introduced from both ends of the tube for drying the coating film, resulting in enabling the shape of the coating film to be maintained to thereby form a dried application film.

Figure 8:
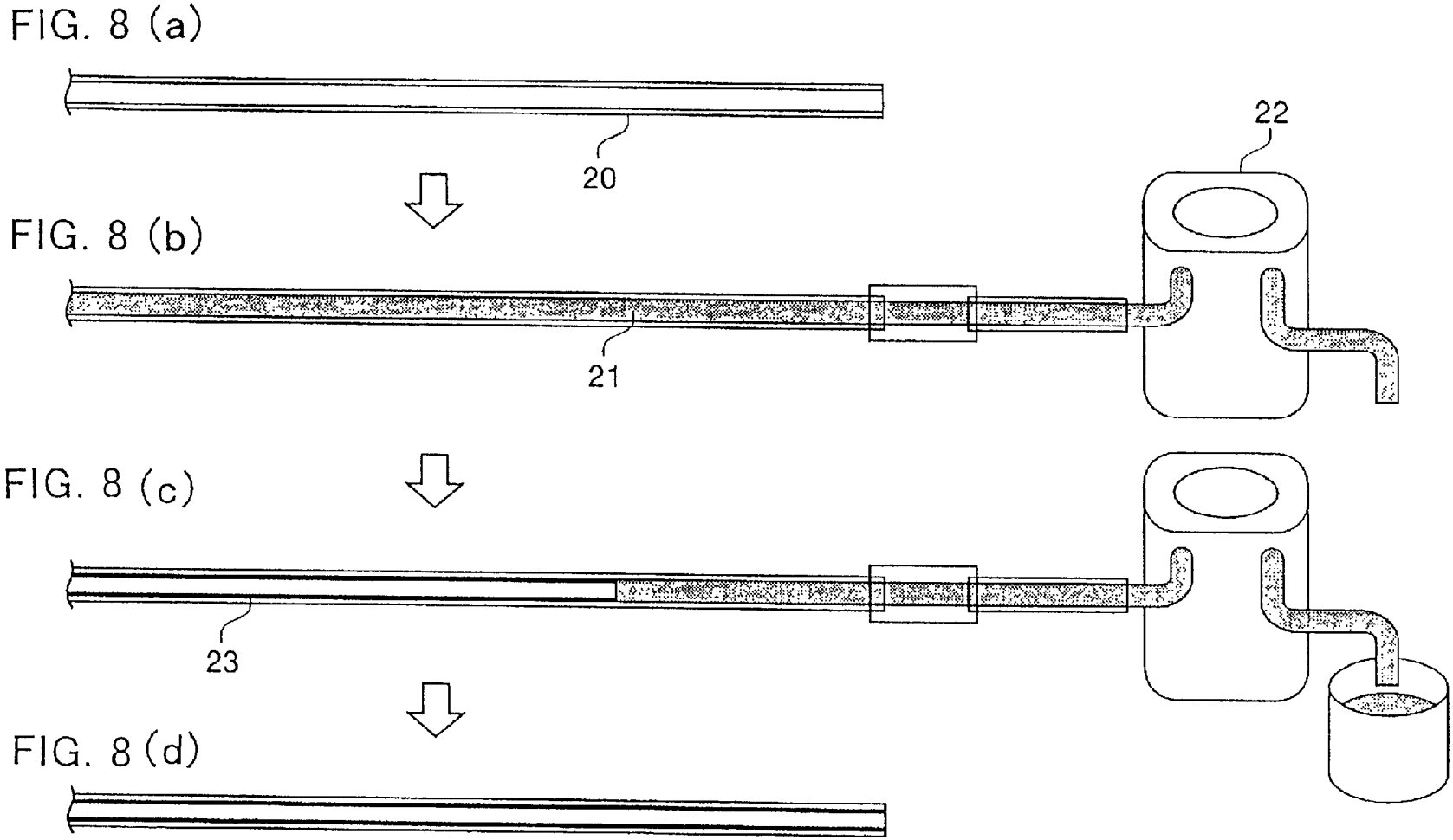
FIGS. 8(*a*) to 8(*d*) are explanatory views showing another method for introducing a coating solution into the gas discharge tube.

FIGS. 8(*a*) to 8(*d*) are explanatory views showing another method for introducing the coating solution into the gas discharge tube.

In this figure, numeral 20 designates a gas discharge tube, numeral 21*a* coating solution, numeral 22 a liquid pump and numeral 23 a coating film. A roller pump is used as the liquid pump 22.

In this introducing method, the gas discharge tube 20 is firstly prepared (see FIG. 8(*a*)), the coating solution 21 is sucked by the liquid pump 22 (see FIG. 8(*b*)), the suction is continued to perform the coating process (see FIG. 8(*c*)) for forming the coating film (see FIG. 8(*d*)). This introducing method can prevent the evaporation of the solvent in the coating solution 21, can keep the component in the coating solution constant and can form a uniform coating film. Further, an air pass is formed in the direction reverse to the coating direction, thereby being capable of simultaneously drying the coating film.

Figure 9:
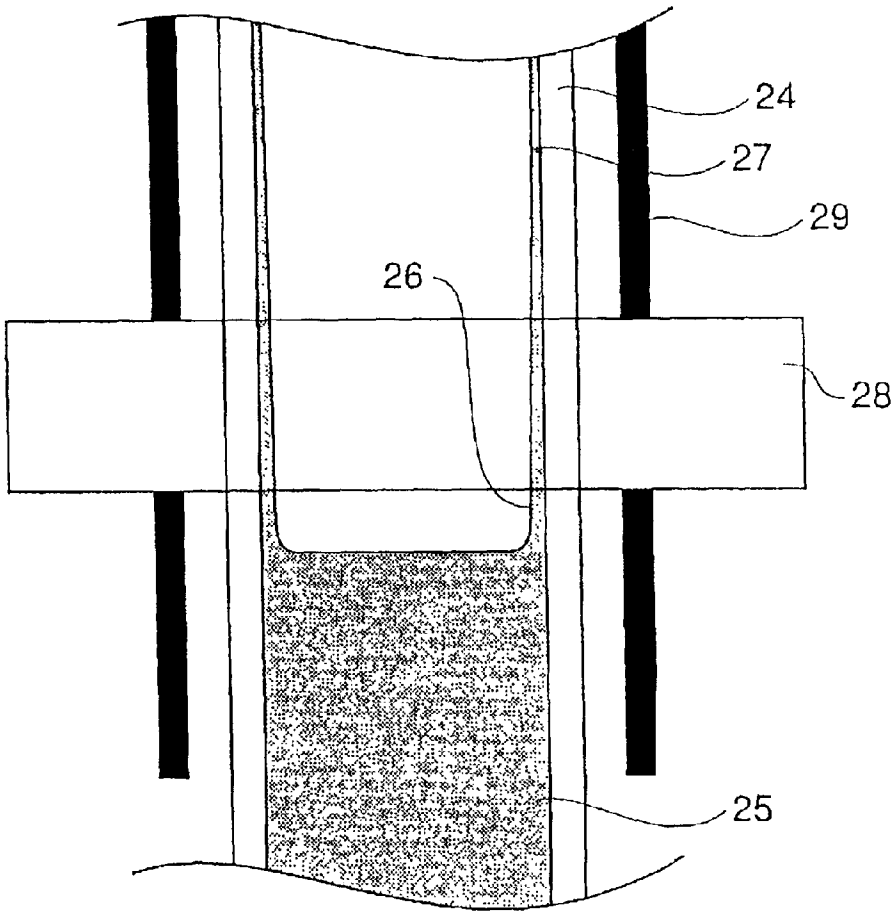
FIGS. 9(*a*) and 9(*b*) are explanatory views showing a method for drying a coating film.
Figure 9:
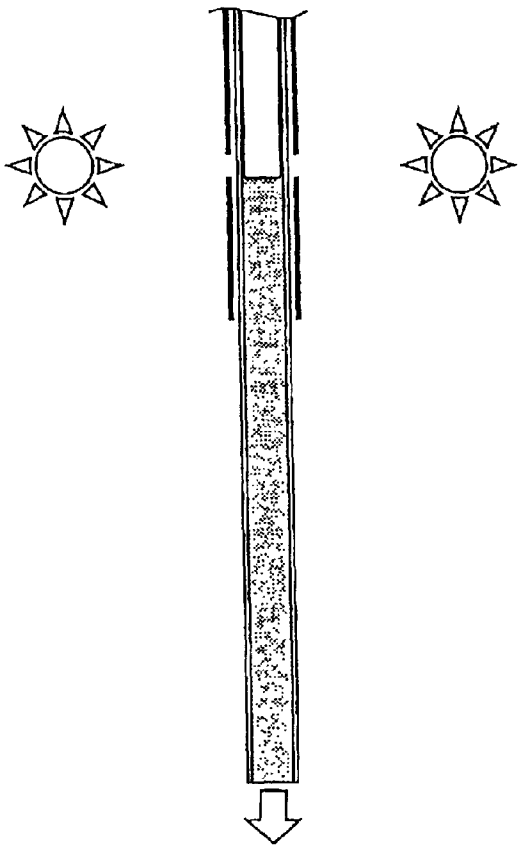

FIGS. 9(*a*) and 9(*b*) are explanatory views showing a drying method of the coating film, wherein FIG. 9(*a*) shows an entire construction of the gas discharge tube and FIG. 9(*b*) shows a portion of the gas discharge tube on which the coating film is formed.

As shown in these figures, a heat source 28 is arranged at the last end of the coating solution 25 upon introducing the coating solution 25 into the gas discharge tube 24. The heat source 28 is moved in accordance with the movement of the coating solution 25 for drying the coating film 26.

The heat source 28 promotes to dry the coating film 26, or changes the coating film 26 to have a high viscosity. Although infrared ray is used for the heat source in this embodiment, microwave or ultraviolet ray can be used as the heat source.

A collimator 29 is locally irradiating the coating film 26 with the heat source 28. This collimator 29 covers the non-irradiated portions for reducing a temperature rise of the coating solution remaining in the tube, resulting in controlling the composition change of the coating solution such as the evaporation of the solvent in the coating solution or the like.

The coating solution 25 trickles down the gas discharge tube 24 to form the coating film 26. Thereafter, the coating film 26 is dried by the heat source 28 to obtain a dried coating film 27. This method can promote the local drying of the coating film. The use of the collimator 29 reduces heat propagation to the non-dried portion, so that the evaporation of the solvent at the boundary of the coating solution and air can be reduced.

At this time, an area where a stabilized film thickness is obtained can be formed by utilizing a tension generating between a meniscus of the coating solution 25, which trickles down the wall of the tube with maintaining a state of filling the cross section of the tube, and the dried coating film 27. Moreover, the liquid face at the last end of the coating solution 25 is moved while locally irradiating this area with the heat source 28 via the collimator 29 to accelerate the drying of the coating film 26. Thereby the film thickness distribution exhibits a constant state from the meniscus of the coating solution 25 to the dried coating film 27, and the dried coating film 27 has an extremely uniform thickness.

Figure 10:
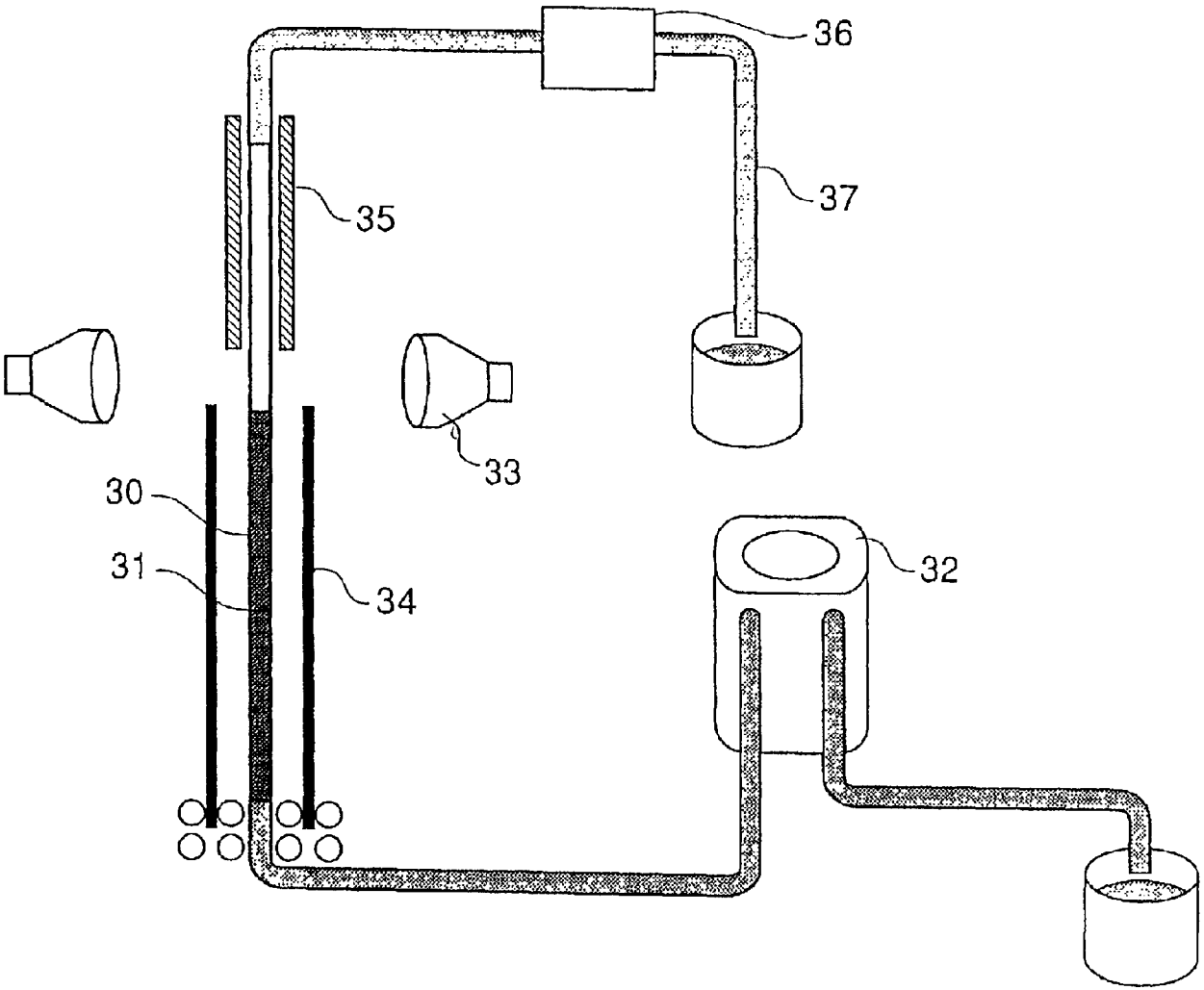
FIG. 10 is an explanatory view showing another method for introducing a coating solution into the gas discharge tube.

FIG. 10 is an explanatory view showing another method for introducing the coating solution into the gas discharge tube.

In this figure, numeral 30 designates a gas discharge tube, numeral 31 a coating solution, numeral 32 a liquid pump, numeral 33 a heat source, numeral 34 a shield plate, numeral 35 a heater, numeral 36 a pump and numeral 37 a condenser. A roller pump is used as the liquid pump 32, since the absorption amount of the roller pump is not so changed due to external force. The shield plate 34 is movably provided for preventing the evaporation of the solvent in the coating solution which remains in the gas discharge tube 30.

In this method, the coating solution 31 is sucked by the liquid pump 32 for performing the coating process to the tube while drying the coating film by the heat source 33. Since the roller pump having the sucking amount not so changed by the external force is used as the liquid pump 32, the roller pump serves as a stopper toward the external force, thereby being able to control the fluctuation at the coating solution surface that is attributed to the pressure of the evaporation from the solvent because of the drying process of the coating film. This brings a stabilized coating speed. Further, dew drops of the solvent evaporation is prevented by using the heater 35 at the area where the dried coating film has already been formed, so that the solvent evaporation generated at the drying process of the coating film does not adhere again to the dried coating film.

Additionally, the pump 36 has mechanisms of rapidly removing the solvent evaporation and of maintaining the pressure in the tube to approximately atmospheric pressure, whereby the evaporation of the solvent from the coating solution surface is prevented as well as the composition of the coating solution can be kept constant. Consequently, the dried coating film having a uniform thickness can be formed. Further, the solvent is rapidly removed by the condenser 37.

Figures 11A, 11B, 11C:
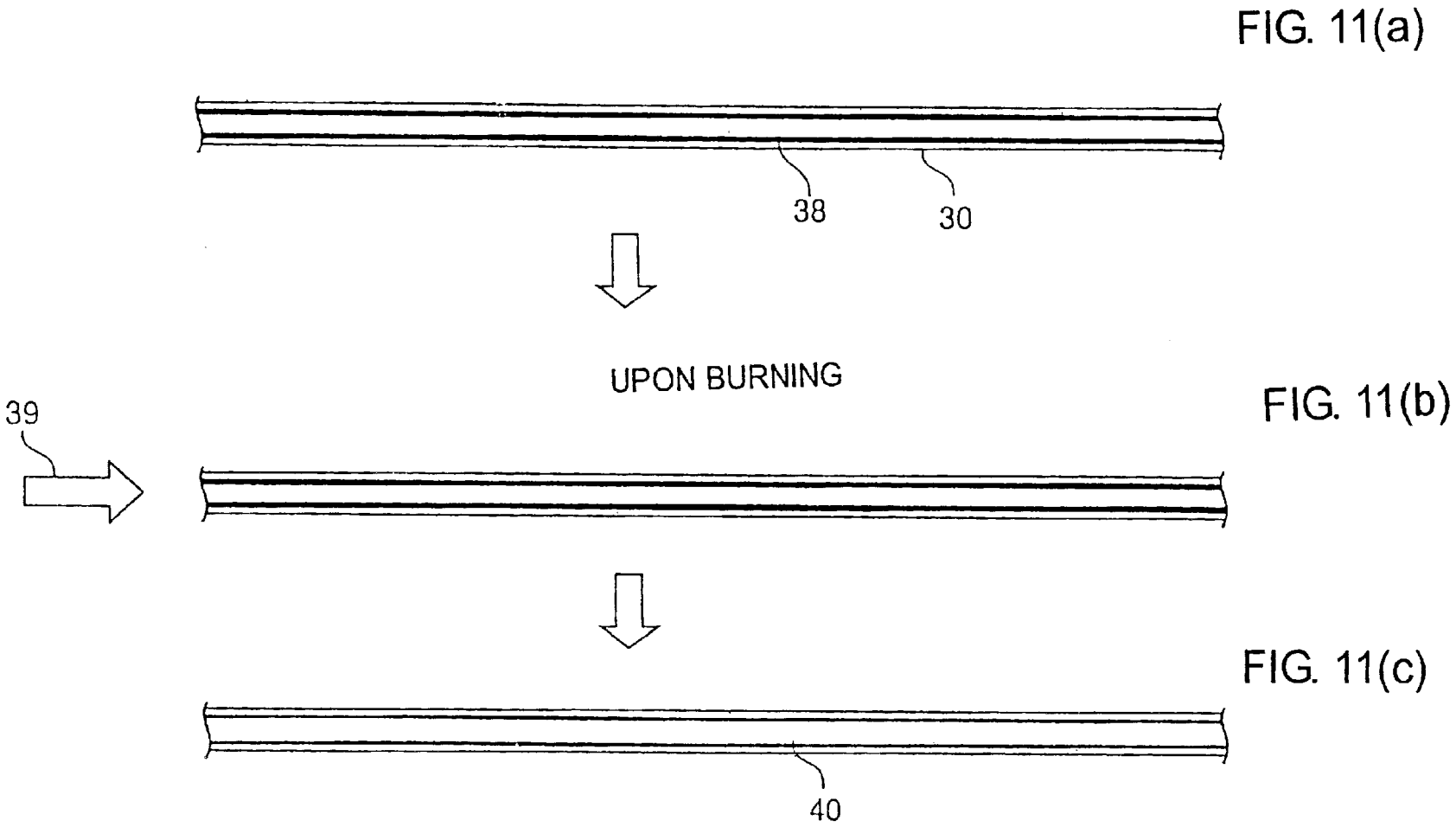
FIGS. 11(*a*) to 11(*c*) are explanatory views showing a method for burning a dried coating film.

FIGS. 11(*a*) to 11(*c*) are explanatory views showing a method for burning the dried coating film.

In this figure, numeral 30 designates a gas discharge tube, numeral 38 a dried coating film, numeral 39 air which is introduced into the gas discharge tube 30 and numeral 40 an electron emission film formed by burning. The dried coating film 38 is formed on the inner wall of the gas discharge tube 30 with a uniform thickness.

Upon burning the dried coating film 38, the air 39 containing oxygen is sent to the gas discharge tube 30, whereby the electron emission film 40 can be formed to have good quality. As the gas discharge tube 30 becomes longer or the diameter of the tube 30 becomes thinner, the oxygen supply required for burning the organic metal compound is tend to be insufficient. Therefore, the air 39 containing oxygen is sent into the tube for eliminating the shortage in oxygen supply, to thereby obtain the excellent electron emission film 40.

A compound serving as the electron emission film 40 is a metal oxide that has an electron emission ability as well as a resistance to heat and a resistance to plasma.

If magnesium is contained in the organic metal compound in the coating solution, an inorganic magnesium compound can be produced by the thermal treatment, while, if aluminum is contained, an inorganic aluminum compound can be produced.

In case where the electron emission film is formed of magnesium oxide, film characteristics having a high electron emission ability can be obtained, while film characteristics having a high electron emission ability and humidity resistance can be obtained in the case of an electron emission film formed of alumina.

Embodiment

Embodiment 1

Figure 12:
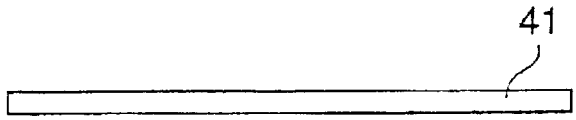
FIGS. 12(*a*) to 12(*e*) are explanatory views showing Embodiment 1 for a method for forming an electron emission film in the gas discharge tube.
Figure 12:
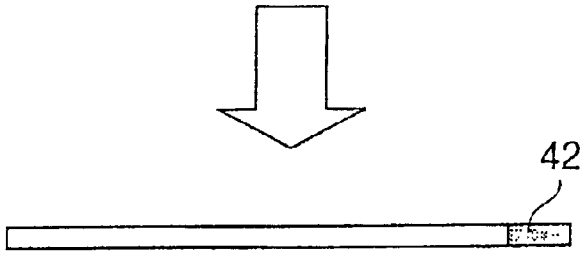
Figure 12:
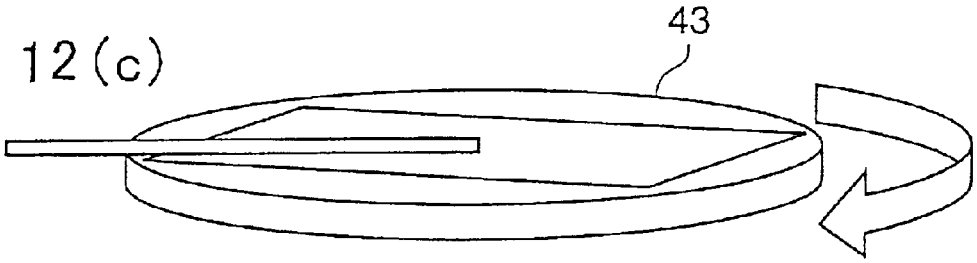
Figure 12:
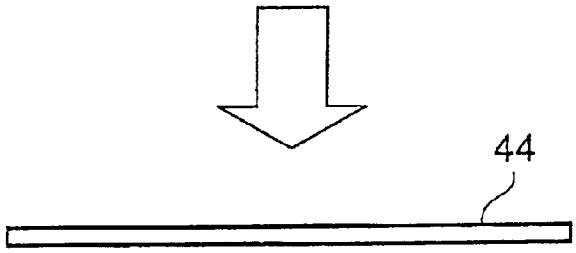
Figure 12:
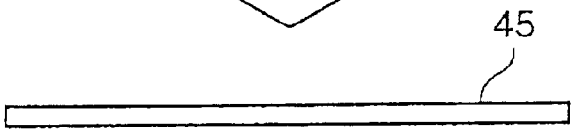

FIGS. 12(*a*) to 12(*e*) are explanatory views showing Embodiment 1 of a method for forming an electron emission film to the inside of the gas discharge tube.

A gas discharge tube 41 used in this embodiment is made of glass, and has an outer diameter of 1.0 mm, inner diameter of 0.8 mm and length of 200 mm. Magnesium hexanoate is used for an organic metal compound that becomes an electron emission film by burning. Used for the coating solution 42 is the one containing ethanol of 1 part and propylene glycol monomethyl ethyl acetate of 1 part per 1 part of magnesium hexanoate.

The gas discharge tube 41 is prepared (see FIG. 12(*a*)), and then, the coating solution 42 is introduced to the edge portion of the gas discharge tube 41 (see FIG. 12(*b*)). Thereafter, the coating solution 42 is uniformly applied to the inner wall of the gas discharge tube by using a rotating device 43 that is a spinner (see FIG. 12(*c*)). At this time, the coating solution 42 is applied with covering the section of the gas discharge tube 41 (see FIG. 12(*d*)).

Subsequently, the gas discharge tube 44 on which the coating film having a uniform thickness is formed is put into a burning furnace to be burned at the maximum temperature of 410° C. for 30 minutes (see FIG. 12(*e*)), resulting in obtaining a gas discharge tube 45 on which a uniform and transparent electron emission film of magnesium oxide was formed.

The thickness of the electron emission film was 6000 Å. Gas of Ne—Xe mixture was enclosed into this gas discharge tube with a pressure of 350 Torr to measuring voltage initiating the discharge.

When the electron emission film is not formed, the discharge is not started until a voltage of AC700V is applied. It was confirmed that the discharge was started with a voltage of AC380V when the gas discharge tube with the electron emission film formed by the method according to the invention was used.

Embodiment 2

Figure 13:
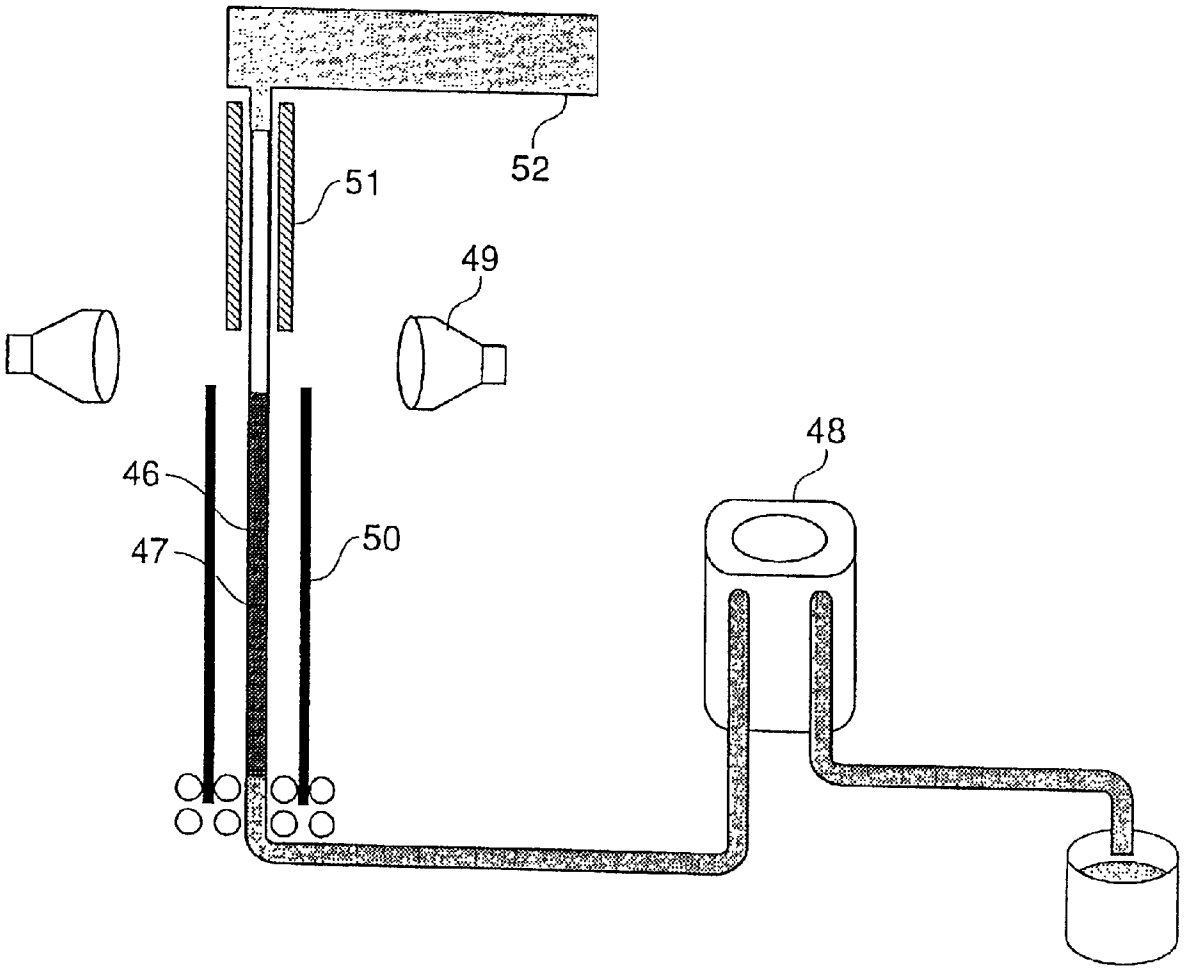
FIG. 13 is an explanatory view showing Embodiment 2 for a method for forming an electron emission film in the gas discharge tube.

FIG. 13 is an explanatory view showing Embodiment 2 of a method for forming an electron emission film on the gas discharge tube.

The gas discharge tube 41 used in this embodiment is also made of glass. This gas discharge tube has an outer diameter of 1.0 mm, inner diameter of 0.8 mm and length of 1000 mm. Magnesium hexanoate is used for an organic metal compound that becomes an electron emission film by burning. Used for the coating solution is the one containing ethanol of 0.5 parts and propylene glycol monomethyl ethyl acetate of 0.8 part per 1 part of magnesium hexanoate.

The coating solution 47 is introduced into a gas discharge tube 46 for filling the tube, and then, the coating solution 47 is moved by a roller pump 48 at a speed of 50 mm per minute, to thereby apply the coating solution 47 onto the inner wall of the gas discharge tube 46. The coated portion is subject to an infrared ray lamp 49 for obtaining a dried coating film. A shielding plate 50 is moved with the coating solution in order not to rise the temperature of the coating solution 47 during the coating process. Evaporation of the solvent is ejected from the side reverse to the coating direction of the gas discharge tube 46. To prevent this evaporation from being condensed on the dried coating film, a heater 51 is used for keeping the gas discharge tube 46 warm. The temperature of the heater 51 is 80° C. The solvent evaporation is liquefied by a condenser 52 disposed at the edge of the gas discharge tube 46 for rapidly removing the solvent evaporation in the gas discharge tube 46.

In this way, a dried coating film having a uniform thickness can be formed in the gas discharge tube having the outer diameter of 1.0 mm, inner diameter of 0.8 mm and the length of 1000 mm. This gas discharge tube was burned at 410° C. with air introduced into the tube, to thereby form an electron emission film of magnesium oxide with good quality.

Explained hereinbefore is the method for forming the electron emission film on the inner wall of the gas discharge tube comprising the step of preparing coating solution containing an organic metal compound, the step of applying this coating solution onto the inner wall of the gas discharge tube and the step of burning the applied coating solution for forming the electron emission film. It is to be noted that there is another method for directly forming the electron emission film on the inner wall of the gas discharge tube by using CVD method.

In the case of forming the electron emission film of magnesium oxide by the CVD method, usable materials include cyclopentadienyl (cp)-containing materials and β-diketone-containing materials. Examples of the cp-containing materials include bis(cyclopentadienyl) magnesium, bis(ethylcyclopentadienyl) magnesium and the like. Examples of β-diketone-containing materials include acetylacetonatomagnesium, dipivaloylmethane magneisum and the like.

bis(cyclopentadienyl)magnesium
$Mg(C_5H_5)_2$
$[cp_2Mg]$
White crystal
Sublimation: 150° C./0.1 Torr
Melting Point: 176 to 178° C.
Become white smoke, Hydrolyzed in water bis(ethylcyclopentadienyl)magnesium
$Mg(C_2H_5C_5H_4)_2$
$[Etcp_2Mg]$
Achromic liquid
Boiling Point: 72° C./0.7 Torr
Melting Point: −17 to −18° C.
Become white smoke, Hydrolyzed in water Acetylacetonatomagnesium
$Mg(acac)_2$
White Powder
Sublimation: 120 to 140° C./1 Torr
Melting Point: 256° C.
Having hygroscopicity but no extreme reactivity Dipivaloylmethanemagnesium
$Mg(DPM)_2$
White Powder
Sublimation: 150° C./0.05 Torr
Melting Point: 135 to 150° C.
Having hygroscopicity but no extreme reactivity The electron emission film may be directly formed on the inner wall of the gas discharge tube with a known CVD method by using the above-mentioned materials.

By this, the voltage initiating the discharge of the gas discharge tube can be reduced, to thereby assure a wide margin of the light-emitting operation at many points. Further, an electron emission film can uniformly be formed at the inner wall of a long, slender tube having a diameter of 2 mm or less and a length of 300 mm or more.

According to the present invention, the voltage initiating the discharge of a gas discharge tube can be reduced, to thereby assure a wide margin of a light-emitting operation at many points.

What is claimed is:

1. A method comprising:

injecting a coating solution at a predetermined amount from one opening of a tube having an opening in each of both ends thereof, said coating solution containing an organic metal compound that turns into an inorganic metal compound having an electron emission ability by a burning process;

forming a coating film on the entire inner wall of the tube by causing the coating solution to go along the inner wall of the tube while entirely sealing the opening of the tube;

burning the coating film to form an electron emission film on the entire inner wall of the tube;

providing a plurality of light-emitting portions in the tube;

providing at least two discharge electrodes on an outside of the tube for applying voltages to the light emitting portions, and locally solidifying the coating film formed in the vicinity of a tailing end of the coating solution going along the inner wall of the tube, wherein the local solidification of the coating film comprises drying the coating film by moving a heat source utilizing visible light or an infrared ray and/or a microwave with the movement of the coating solution and irradiating the coating film with the visible light or infrared ray and/or microwave, or fixing the metal compound in the coating film to the inner wall of the tube by moving a ultraviolet ray irradiating device with the movement of the coating solution and irradiating the coating film with the ultraviolet ray, the tube thereby being a gas discharge tube having an electron emission film formed on the entire inner wall of the tube for improving discharge characteristics.

2. The method as claimed in claim 1, wherein the organic metal compound comprises magnesium hexanoate and the electron emission film comprises magnesium oxide film.

3. The method as claimed in claim 1, further comprising:

using one or more forces of centrifugal force, gas pressure and liquid pressure for causing the coating solution to go along the tube.

4. The method as claimed in claim 1, further comprising:

drying the coating film by sending blast into the tube alternately from both ends of the tube.

5. A method comprising:

injecting a coating solution at a predetermined amount from one opening of a tube having an opening in each of both ends thereof, said coating solution containing an organic metal compound that turns into an inorganic metal compound having an electron emission ability by a burning process;

forming a coating film on the entire inner wall of the tube by causing the coating solution to go along the inner wall of the tube while entirely sealing the opening of the tube;

burning the coating film to form an electron emission film on the entire inner wall of the tube;

providing a plurality of light-emitting portions in the tube;

providing at least two discharge electrodes on an outside of the tube for applying voltages to the plurality of light-emitting portions, the electron emission film being made of magnesium oxide; and locally solidifying the coating film formed in the vicinity of a tailing end of the coating solution going along the inner wall of the tube, wherein the local solidification of the coating film comprises drying the coating film by moving a heat source utilizing visible light or an infrared ray and/or a microwave with the movement of the coating solution and irradiating the coating film with the visible light or infrared ray and/or microwave, or fixing the metal compound in the coating film to the inner wall of the tube by moving a ultraviolet ray irradiating device with the movement of the coating solution and irradiating the coating film with the ultraviolet ray, the tube thereby being a gas discharge tube having an electron emission film formed on the entire wall of the tube for improving discharge characteristics.

6. A method comprising:

injecting a coating solution at a predetermined amount from one opening of a tube having an opening in each of both ends thereof, said coating solution containing an organic metal compound that turns into an inorganic metal compound having an electron emission ability by a burning process;

forming a coating film on the entire inner wall of the tube by causing the coating solution to go along the inner wall of the tube while entirely sealing the opening of the tube;

burning the coating film to form an electron emission film on the entire inner wall of the tube;

providing a plurality of light-emitting portions in the tube;

providing at least two discharge electrodes on an outside of the tube;

providing a common electrode extending in a longitudinal direction of the tube;

providing a plurality of separate electrodes that oppose to the common electrode with respect to the tube and which are arranged at spaced intervals in the longitudinal direction of the tube, the light-emitting portions being formed in the tube at positions where the separate electrodes and the common electrode oppose to each other; and locally solidifying the coating film formed in the vicinity of a tailing end of the coating solution going along the inner wall of the tube, wherein the local solidification of the coating film comprises drying the coating film by moving a heat source utilizing visible light or an infrared ray and/or a microwave with the movement of the coating solution and irradiating the coating film with the visible light or infrared ray and/or microwave, or fixing the metal compound in the coating film to the inner wall of the tube by moving a ultraviolet ray irradiating device with the movement of the coating solution and irradiating the coating film with the ultraviolet ray, the tube thereby being a gas discharge tube having an electron emission film formed on the entire wall of the tube for improving discharge characteristics.

7. A method comprising:

injecting a coating solution at a predetermined amount from one opening of a tube having an opening in each of both ends thereof, said coating solution containing an organic metal compound that turns into an inorganic metal compound having an electron emission ability by a burning process;

forming a coating film on the entire inner wall of the tube by causing the coating solution to go along the inner wall of the tube while entirely sealing the opening of the tube;

burning the coating film to form an electron emission film on the entire inner wall of the tube; and locally solidifying the coating film formed in the vicinity of a tailing end of the coating solution going along the inner wall of the tube, wherein the local solidification of the coating film comprises drying the coating film by moving a heat source utilizing visible light or an infrared ray and/or a microwave with the movement of the coating solution and irradiating the coating film with the visible light or infrared ray and/or microwave, or fixing the metal compound in the coating film to the inner wall of the tube by moving a ultraviolet ray irradiating device with the movement of the coating solution and irradiating the coating film with the ultraviolet ray, the tube thereby being a gas discharge tube having the electron emission film formed on the inner wall of the tube to improve discharge characteristics.

8. The method as claimed in claim 7, wherein the organic metal compound comprises magnesium hexanoate and the electron emission film comprises magnesium oxide film.

9. The method as claimed in claim 7, further comprising:

using one or more forces of centrifugal force, gas pressure and liquid pressure for causing the coating solution to go along the tube.

10. The method as claimed in claim 7, further comprising:

drying the coating film by sending blast into the tube alternately from both ends of the tube.

11. The method as claimed in claim 7, further comprising:

forming at least two discharge electrodes on an outside of the tube.

12. A method comprising:

injecting a coating solution at a predetermined amount from one opening of a tube having an opening in each of both ends thereof, said coating solution containing an organic metal compound that turns into an inorganic metal compound having an electron emission ability by a burning process;

forming a coating film on the entire inner wall of the tube by causing the coating solution to go along the inner wall of the tube while entirely sealing the opening of the tube;

burning the coating film to form an electron emission film on the entire inner wall of the tube;

providing a plurality of light-emitting portions in the tube;

providing at least two discharge electrodes on an outside of the tube for applying voltages to the light emitting portions; and locally solidifying the coating film formed in the vicinity of a tailing end of the coating solution going along the inner wall of the tube, wherein the local solidification of the coating film comprises drying the coating film by moving a heat source utilizing visible light or an infrared ray and/or a microwave with the movement of the coating solution and irradiating the coating film with the visible light or infrared ray and/or microwave, the tube thereby being a gas discharge tube having an electron emission film formed on the entire inner wall of the tube for improving discharge characteristics.

13. A method comprising:

injecting a coating solution at a predetermined amount from one opening of a tube having an opening in each of both ends thereof, said coating solution containing an organic metal compound that turns into an inorganic metal compound having an electron emission ability by a burning process;

forming a coating film on the entire inner wall of the tube by causing the coating solution to go along the inner wall of the tube while entirely sealing the opening of the tube;

burning the coating film to form an electron emission film on the entire inner wall of the tube;

providing a plurality of light-emitting portions in the tube;

providing at least two discharge electrodes on an outside of the tube for applying voltages to the light emitting portions; and locally solidifying the coating film formed in the vicinity of a tailing end of the coating solution going along the inner wall of the tube, wherein the local solidification of the coating film comprises fixing the metal compound in the coating film to the inner wall of the tube by moving a ultraviolet ray irradiating device with the movement of the coating solution and irradiating the coating film with the ultraviolet ray, the tube thereby being a gas discharge tube having an electron emission film formed on the entire inner wall of the tube for improving discharge characteristics.

* * * * *

UNITED STATES PATENT AND TRADEMARK OFFICE

CERTIFICATE OF CORRECTION

PATENT NO. : 6,932,664 B2
DATED : August 23, 2005
INVENTOR(S) : Hitoshi Yamada et al.

It is certified that error appears in the above-identified patent and that said Letters Patent is hereby corrected as shown below:

Title page,
Item [74], *Attorney, Agent, or Firm*, after "Halsey" insert -- LLP --.
Item [56], References Cited, U.S. PATENT DOCUMENTS, insert the following:

| | | | |
|---|---|---|---|
| -- US 3,596,095 | 07-1971 | Leach, Sam L. | 250/461.1 |
| US 3,947,722 | 03-1976 | Strom et al. | 315/169.4 |
| US 5,006,758 | 04-1991 | Gellert et al. | 313/634 |
| US 5,514,934 | 05-1996 | Matsumoto et al. | 313/607 |
| US 5,889,366 | 03-1999 | Yokokawa et al. | 313/607 |
| US 6,577,060 | 06-2003 | Tokai et al. | 313/581 |
| US 6,612,889 | 09-2003 | Green et al. | 445/24 |
| US 6,633,117 | 0-2003 | Shinoda et al. | 313/484 --. |

Signed and Sealed this

Fourth Day of April, 2006

JON W. DUDAS
*Director of the United States Patent and Trademark Office*